US011673710B2

(12) United States Patent
Nelson

(10) Patent No.: US 11,673,710 B2
(45) Date of Patent: Jun. 13, 2023

(54) SECURING APPARATUS FOR PACKAGING AND SHIPPING

(71) Applicant: Encore Packaging LLC, Vernon Hills, IL (US)

(72) Inventor: Timothy H. Nelson, Winnetka, IL (US)

(73) Assignee: ENCORE PACKAGING LLC, Vernon Hills, IL (US)

( * ) Notice: Subject to any disclaimer, the term of this patent is extended or adjusted under 35 U.S.C. 154(b) by 172 days.

(21) Appl. No.: 17/149,531

(22) Filed: Jan. 14, 2021

(65) Prior Publication Data

US 2022/0219861 A1 Jul. 14, 2022

(51) Int. Cl.
*B65D 19/44* (2006.01)

(52) U.S. Cl.
CPC ..... *B65D 19/44* (2013.01); *B65D 2519/0082* (2013.01)

(58) Field of Classification Search
CPC ..... B65D 19/44; B65D 2519/0082
See application file for complete search history.

(56) References Cited

U.S. PATENT DOCUMENTS

| | | | | |
|---|---|---|---|---|
| 1,895,766 | A | 1/1933 | Murphy | |
| 2,351,525 | A | 6/1944 | Leary | |
| 2,385,209 | A | 9/1945 | Joyce | |
| 2,564,517 | A | 8/1951 | Beals | |
| D172,029 | S | 4/1954 | Johnson | |
| 3,173,539 | A * | 3/1965 | Looker | B65D 63/14 410/97 |
| 3,492,389 | A | 1/1970 | Port | |
| 3,754,636 | A | 8/1973 | Boy | |
| 3,759,169 | A | 9/1973 | Goodley | |
| 3,836,106 | A | 9/1974 | Gray | |
| 3,969,793 | A | 7/1976 | Crosby | |
| 4,009,235 | A | 2/1977 | Bober | |
| 4,102,513 | A | 7/1978 | Guard | |

(Continued)

FOREIGN PATENT DOCUMENTS

WO 9207761 A1 5/1992

OTHER PUBLICATIONS

Western Plastics Internet Page; 'Air-Flow'; http://www.wplastics.com/pg_ind_page11.asp; 2 pages. Available at least as early as Mar. 9, 2013.

(Continued)

*Primary Examiner* — Anita M King
(74) *Attorney, Agent, or Firm* — Fitch, Even, Tabin & Flannery LLP

(57) ABSTRACT

A securing apparatus configured to assist in securing objects to a pallet during packaging and shipping includes a main body having first and second wall portions spaced from one another to define a channel, and a hook extending from the main body via a neck portion. At least one of the first and second wall portions includes an anchor for engaging and being embedded in a pallet. A fastener may be received through an aperture of the main body to releasably attach the securing apparatus to a pallet, and the anchor may be at least partially embedded in the pallet. So configured, a filament may be looped about the hook to assist in securing objects to the pallet in a first securing configuration, and another filament may be received in the channel to assist in securing objects to the pallet in a second securing configuration.

26 Claims, 9 Drawing Sheets

(56) References Cited

U.S. PATENT DOCUMENTS

| | | | | |
|---|---|---|---|---|
| 4,166,589 | A | 9/1979 | Hoover | |
| 4,255,918 | A | 3/1981 | Lancaster | |
| 4,271,657 | A | 6/1981 | Lancaster | |
| 4,336,679 | A | 6/1982 | Lancaster | |
| 4,387,552 | A | 6/1983 | Lancaster | |
| 4,432,185 | A | 2/1984 | Geisinger | |
| 4,502,911 | A | 3/1985 | Discavage | |
| 4,535,951 | A | 8/1985 | Riemenschneider | |
| 4,605,456 | A | 8/1986 | Annis, Jr. | |
| 4,671,043 | A | 6/1987 | Forni | |
| D295,525 | S | 5/1988 | Sakaki | |
| 4,807,427 | A | 2/1989 | Casteel | |
| 4,905,451 | A | 3/1990 | Jaconelli | |
| D307,435 | S | 4/1990 | Sakaki | |
| D308,977 | S | 7/1990 | Sakaki | |
| 5,125,209 | A | 6/1992 | Thimon | |
| 5,139,403 | A | 8/1992 | Stuart | |
| 5,168,685 | A | 12/1992 | Suzuki | |
| 5,447,009 | A | 9/1995 | Oleksy | |
| 5,452,566 | A | 9/1995 | Benhamou | |
| 5,463,843 | A | 11/1995 | Sharp | |
| 5,531,393 | A | 7/1996 | Salzsauler | |
| D393,201 | S | 4/1998 | Hearidge | |
| 5,775,084 | A | 7/1998 | Bernhardy | |
| 5,884,857 | A | 3/1999 | Martin-Cocher | |
| D415,570 | S | 10/1999 | Bradshaw | |
| 6,009,681 | A | 1/2000 | Kozloff | |
| D424,078 | S | 5/2000 | Chin-Chang | |
| D448,987 | S | 10/2001 | Davis | |
| 6,360,512 | B1 | 3/2002 | Marois | |
| 6,450,515 | B1 | 9/2002 | Guth | |
| 6,463,721 | B1 | 10/2002 | Su | |
| 6,568,159 | B2 | 5/2003 | Kawai | |
| 6,663,069 | B1 | 12/2003 | Norberg | |
| D488,822 | S | 4/2004 | Shibazaki | |
| 6,745,544 | B2 | 6/2004 | Matsumoto | |
| 6,745,678 | B1 | 6/2004 | Liu | |
| 6,789,469 | B1 | 9/2004 | Tipton | |
| 6,874,297 | B2 | 4/2005 | Solis | |
| 6,994,019 | B1 | 2/2006 | Liu | |
| D545,183 | S | 6/2007 | French | |
| D546,852 | S | 7/2007 | Shimojima | |
| D547,779 | S | 7/2007 | Shimojima | |
| 7,263,928 | B1 | 9/2007 | Holden | |
| 7,270,055 | B1 | 9/2007 | Haberstroh | |
| D552,463 | S | 10/2007 | French | |
| 7,357,349 | B1 | 4/2008 | Huang | |
| D578,383 | S | 10/2008 | Adams | |
| 7,581,368 | B1 | 9/2009 | Bison | |
| D608,189 | S | 1/2010 | Jackson | |
| 7,779,607 | B2 | 8/2010 | Lancaster | |
| 7,908,831 | B1 | 3/2011 | Dugan | |
| 8,037,660 | B2 | 10/2011 | Lancaster | |
| 8,053,056 | B2 | 11/2011 | Heikaus | |
| 8,099,935 | B2 | 1/2012 | Forni | |
| D663,357 | S | 7/2012 | Bookhamer | |
| D669,773 | S | 10/2012 | Colasse | |
| 8,276,346 | B2 | 10/2012 | Lancaster | |
| 8,276,354 | B2 | 10/2012 | Lancaster | |
| D675,512 | S | 2/2013 | Gary | |
| 8,549,819 | B1 | 10/2013 | Bison | |
| 8,707,664 | B1 | 4/2014 | Bison | |
| 8,727,288 | B2 * | 5/2014 | Ruiz | F16L 3/00 248/65 |
| D729,025 | S | 5/2015 | Chance | |
| 9,850,011 | B2 | 12/2017 | Nelson | |
| 10,253,905 | B2 * | 4/2019 | Martin | H02G 3/32 |
| 10,279,945 | B2 | 5/2019 | Nelson | |
| 10,847,960 | B1 * | 11/2020 | Naugler | F16B 2/22 |
| 2003/0009995 | A1 | 1/2003 | Pearson | |
| 2004/0098953 | A1 | 5/2004 | Devine | |
| 2004/0255562 | A1 | 12/2004 | Haberstroh | |
| 2004/0255797 | A1 | 12/2004 | Bobren | |
| 2005/0044812 | A1 | 3/2005 | Lancaster | |
| 2005/0061165 | A1 | 3/2005 | Powers | |
| 2005/0123721 | A1 | 6/2005 | Heikaus | |
| 2007/0095991 | A1 | 5/2007 | Fall | |
| 2007/0197117 | A1 | 8/2007 | Austin | |
| 2007/0204565 | A1 | 9/2007 | Lancaster | |
| 2009/0205999 | A1 * | 8/2009 | Smith | B65D 19/40 108/55.5 |
| 2010/0154661 | A1 | 6/2010 | Bobren | |
| 2011/0120056 | A1 | 5/2011 | Smith | |
| 2011/0120321 | A1 | 5/2011 | Oehm | |
| 2011/0233321 | A1 | 9/2011 | Yu Chen | |
| 2012/0216688 | A1 | 8/2012 | Liu | |
| 2014/0109523 | A1 | 4/2014 | Nelson | |
| 2014/0331609 | A1 | 11/2014 | Bison | |
| 2015/0000570 | A1 * | 1/2015 | Day | B65D 19/44 108/55.1 |
| 2015/0203232 | A1 | 7/2015 | Nelson | |
| 2018/0045335 | A1 * | 2/2018 | Martin | F16L 3/04 |
| 2020/0366076 | A1 * | 11/2020 | Naugler | H02G 3/32 |
| 2022/0144518 | A1 * | 5/2022 | Nelson | B65D 81/056 |

OTHER PUBLICATIONS

Western Plastics Internet Page; 'Can Air-Flow Solve Your Problems?'; http://www.wplastics.com/articles/af article_003.asp; 2 pages. Available at least as early as Mar. 9, 2013.

Western Plastics Internet Page; 'Seven Reasons Why You Should Sell Air-Flow'; http://www.wplastics.com/articles/af article_001.asp; 2 pages. Available at least as early as Mar. 9, 2013.

Western Plastics Internet Page; "Air-Flow Overview"; http://www.wplastics.com/articles/af_article_004.asp; 2 pages. Available at least as early as Mar. 9, 2013.

Western Plastics Internet Page; "Air-Flow Premium Stretches 200% and Works on All Brand Name Equipment"; http://www.wplastics.com/airflow_premium.asp; 2 pages. Available at least as early as Mar. 9, 2013.

Western Plastics Internet Page; "Air-Flow Premium"; http://www.wplastics.com/pg_ind_page12.asp; 2 pages. Available at least as early as Mar. 9, 2013.

Western Plastics Internet Page; "Air-Flow Sales Soar!"; http://www.wplastics.com/airflow.asp; 2 pages. Available at least as early as Mar. 9, 2013.

Western Plastics Internet Page; "Distributor's Air-Flow Hit List"; http://www.wplastics.com/articles/af_article_002. asp; 2 pages. Available at least as early as Mar. 9, 2013.

Western Plastics Internet Page; "How to Apply Air-Flow for the Best Results"; http://www.wplastics.com/articles/af article_006.asp; 2 pages. Available at least as early as Mar. 9, 2013.

* cited by examiner

SECURING APPARATUS FOR PACKAGING AND SHIPPING

TECHNICAL FIELD

The present disclosure relates generally to the packaging and shipping of objects and, more specifically, to a securing apparatus for the packaging and shipping of objects using a pallet.

BACKGROUND

Storage containers such as boxes are commonly used for packaging, shipping, and delivery of certain goods. To package and ship goods in an efficient manner, it may be desirable to stack various storage containers on a pallet and secure the storage containers thereto using stretch wrap and some form of rope or filament. For example, storage containers may be placed on a pallet, and stretch wrap may be wrapped in multiple layers around a periphery of the containers to inhibit their undesired lateral movement during transit. In addition, a length of filament such as a rope or string may be wrapped around the top of the storage containers and secured to a portion of the pallet underneath to further secure the containers and minimize undesirable movements.

In some instances, filament for securing such containers to a pallet may simply be tied around one of the boards forming the pallet, or in other instances, the filament may be wrapped around the top, sides, and bottom of the stack of storage containers and may be tied to itself. However, the filament may not be completely secured and may become loose or detached during transit. As a result, the storage containers may inadvertently shift on and/or fall from the pallet, which may damage any goods contained therein.

Figure 1:
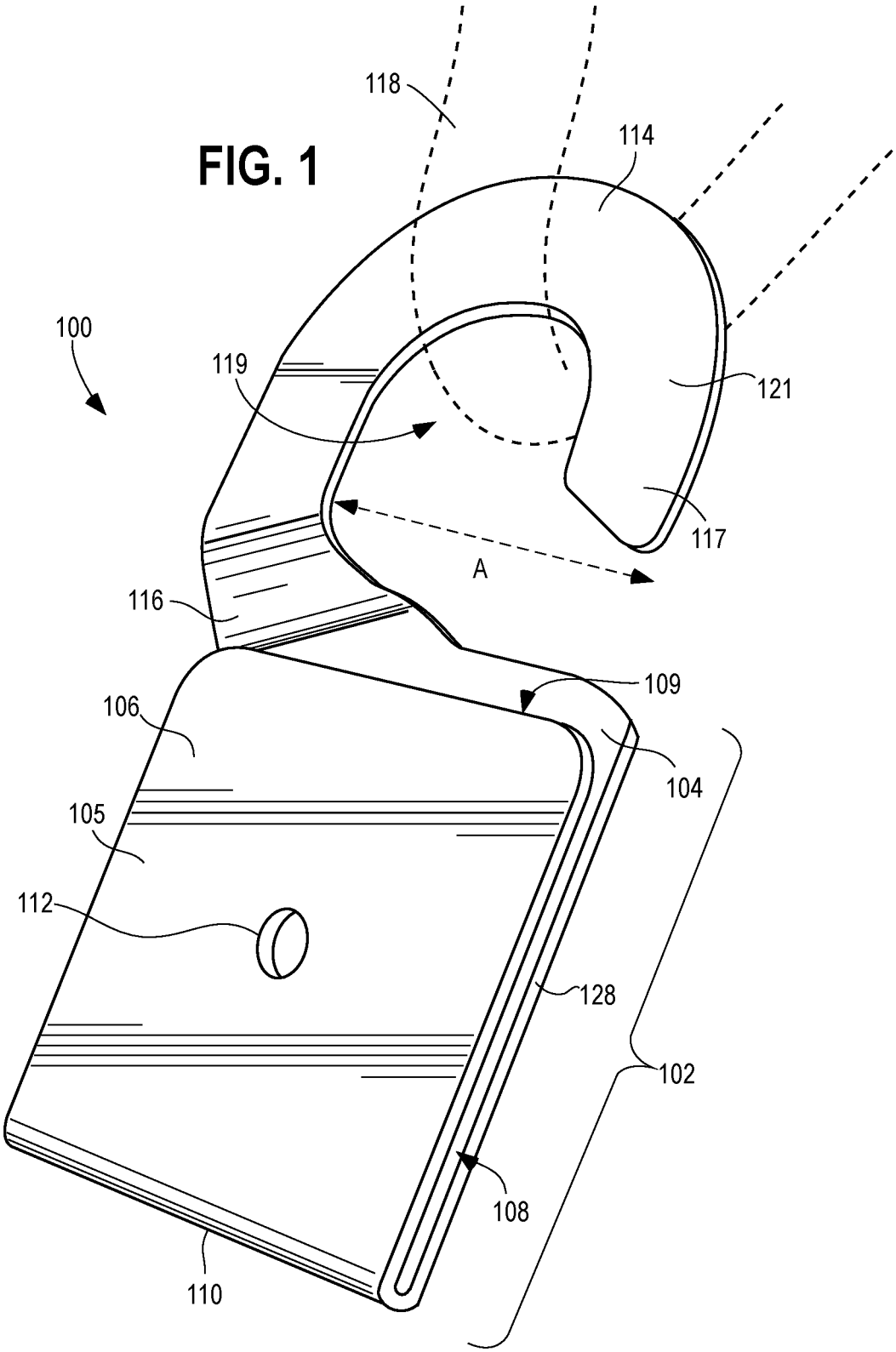
FIG. 1 is a perspective view of an example securing apparatus having a main body including two plate-like wall portions forming a channel therebetween, and a hook attached to the main body via a neck portion.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present disclosure. Also, common but well-understood elements that are useful or necessary in a commercially feasible embodiment are often not depicted to facilitate a less obstructed view of the various embodiments. It will further be appreciated that certain actions and/or steps may be described or depicted in a particular order of occurrence while those skilled in the art will understand that such specificity with respect to sequence is not actually required.

DETAILED DESCRIPTION

In accordance with one aspect of the present disclosure, a securing apparatus is configured to assist in securing objects to a pallet during packaging and shipping. The securing apparatus has a main body and a hook extending therefrom via a neck portion. The main body includes a first wall portion and a second wall portion spaced from the first wall portion to form a channel therebetween. Additionally, the main body includes at least one anchor extending therefrom for engaging and being embedded in a pallet. A fastener may be received through an aperture of the main body to releasably attach the securing apparatus to a pallet, and the at least one anchor may be at least partially embedded in the pallet. So configured, the securing apparatus may be releasably attached to a pallet such that a length of filament may be looped about the hook to assist in securing objects to the pallet in a first securing configuration, and another length of filament may be received in the channel between the first and second wall portions to assist in securing objects to the pallet in a second securing configuration. In some forms, the securing apparatus may be provided alone or may alternatively be provided with one or more fasteners in the form of a kit.

In another aspect, the present disclosure provides a method of securing one or more objects to a pallet using an example securing apparatus as described herein. A securing apparatus having a main body may be provided and positioned proximate a surface of a pallet, and a fastener may be received through an aperture of the main body to removably couple the securing apparatus to the pallet. The example method may further include embedding at least one anchor of the securing apparatus in a surface of the pallet. Once the securing apparatus is attached, a length of filament may be looped around a hook of the securing apparatus to assist in securing objects to the pallet in a first securing configuration. Additionally or alternatively, another length of filament may be received in a channel of the main body to assist in securing objects to the pallet in a second securing configuration.

In yet another aspect, a method for forming an example securing apparatus from a monolithic blank of material includes cutting the blank from a sheet of material and cutting an aperture in the main body of the blank. An opening may then be cut in the main body to define a plurality of anchors, and the anchors may then be bent and oriented outward from the opening such that the anchors are disposed generally transverse the surface of the blank. The blank is then bent about a spine portion to form first and second wall portions spaced from one another to define a channel therebetween for receiving a length of filament. In some forms, a neck portion of the blank may be bent at an angle relative to the main body, and a hook extending from the neck portion may be correspondingly bent such that the hook is oriented in a plane generally parallel to, and offset from, the main body.

Referring now to the drawings, and more particularly FIG. 1, an example securing apparatus 100 is provided including a main body 102 having a plate-like first wall portion 104 and a plate-like second wall portion 106 spaced from the first wall portion 104 to form a channel 108 therebetween. As illustrated, the first and second wall portions 104, 106 are formed by the main body 102 being folded about a spine portion 110 such that the first and second wall portions 104, 106 are oriented generally parallel one another. The second wall portion 106 includes an aperture 112 extending therethrough to facilitate attachment of the securing apparatus 100 to a pallet, as described in further detail below. For example, the securing apparatus 100 may be positioned proximate a pallet (e.g., a pallet made of wood or a composite material resembling wood), and a fastener 113 such as a screw 114 having shank 111 (see FIGS. 3 and 4) may be inserted through the aperture 112, contact a surface of the pallet 140, and be advanced therein to removably attach the securing apparatus 100 thereto. The example securing apparatus 100 may be made of a metal material or alternatively may be formed of a durable plastic or polymer material or other suitable material.

Figure 2:
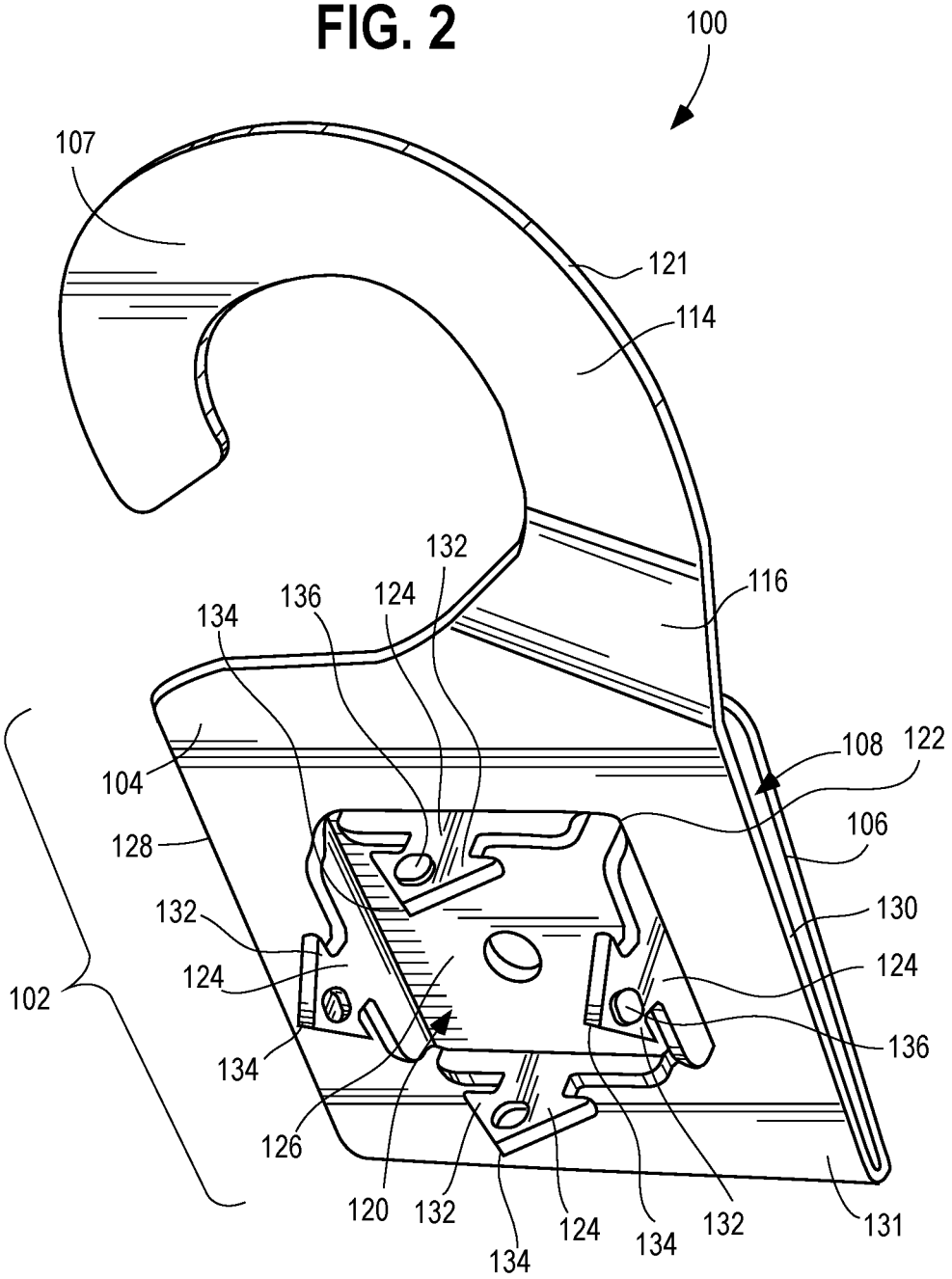
FIG. 2 is a rear perspective view of an opposite side of the securing apparatus of FIG. 1 showing a plurality of anchors extending outward from the first wall portion.

In addition, the securing apparatus 100 includes a hook 114 that is attached to the main body 102, and planarly offset therefrom in an axial direction A, via a neck portion 116. As illustrated, the hook 114 is generally plate-like with a uniformly level upper surface 117 and lower surface 107 (see FIG. 2) and includes a curved, C-shaped portion 121 for retaining a length of filament 118 therearound. In the context of the present disclosure, the filament 118 should be understood to encompass any form of string, rope, wire, strapping, stretch wrap string, twine, cord, cable, elastic bands, strand of material, or other similar rope-like structures that may be used to tie one or more objects to a delivery structure such as a pallet. In alternative embodiments, the hook 114 may be formed in different shapes and configurations, such as having a circular cross-section. As shown in FIGS. 1 and 2, the first wall portion 104 of the main body 102 is oriented in a first plane, and the neck portion 116 extends from main body 102 at an angle such that hook 114 is oriented superior to the first wall portion 104 relative to the axial direction A in a second plane generally parallel to the first plane. In the context of the present disclosure, generally parallel should be understood to mean that the second plane is oriented within about five to ten degrees of parallel to the first plane. In other aspects, the hook 114 may be oriented at an angle relative to the first plane such as about ten degrees to about forty-five degrees.

Although the neck portion 116 as shown in FIG. 1 is illustrated as extending from a left-side of the first wall portion 104, the neck portion 116 may alternatively extend from a right-side of the first wall portion 104 or a central area of the first wall portion 104. In still other embodiments, the neck portion 116 may alternatively extend from other portions of the main body 102, such as the second wall portion 106.

Referring now to FIG. 2, a rear perspective view of the securing apparatus 100 is illustrated showing a plurality of anchors 124 extending from the main body 102. More specifically, an opening 120 of the first wall portion 104 is shown having a periphery 122 with four anchors 124 extending therefrom. Although described as including four anchors 124 with respect to FIG. 2, it should be understood that one or more anchors may be used to facilitate attachment of the securing apparatus 100 to a pallet, not necessarily four. As shown, the anchors 124 extend outward from the periphery 122 of the opening 120 away from an outer surface 131 of the first wall portion 104 generally transverse the first plane on which the first wall portion 104 is oriented. The anchors 124 include distal portions 132 for engaging with a pallet formed in a generally arrow-like shape. In other forms, the distal portions 132 may formed in other configurations sufficient to engage and/or penetrate a pallet surface. As illustrated, the arrow-like distal portions 132 terminate in a point 134 to facilitate piercing of a pallet surface. So configured, the anchors 124 are positioned so as to engage, and be embedded in, a surface of a pallet when the securing apparatus 100 is attached thereto (see e.g., pallet 140 in FIG. 4).

The anchors 124 of the securing apparatus 100 may assist in providing sufficient strength to both grip in the pallet to which the apparatus 100 is attached, and to withstand forces applied to the securing apparatus 100 by the filaments used for securing a load to the pallet. For example, heavy goods or objects shifting on the pallet during transit or delivery may apply tension to the filament 118 which may pull on a portion of the securing apparatus 100 (e.g., the hook 114). Embedding of the anchors 124 in the pallet may inhibit inadvertent detachment of the securing apparatus 100 based at least in part on the additional grip provided.

In some forms, the anchors 124 may be monolithic with the main body 102 of the securing apparatus 100, or alternatively may be formed as separate components and attached to the main body 102. In still other forms, the anchors 124 may extend from other portions of the main body 102, such as an inner surface 126 of the second wall portion 106, or the lateral edges 128, 130 of the first wall portion 104. Although illustrated as arrow-like projections, the anchors 124 may be likewise be formed as spikes, barbs, or other similar structure for encouraging retainment of the securing apparatus 100 to the pallet by engaging a surface thereof.

Additionally, one or more of the anchors 124 may include an engaging feature 136 such as a projection, barb, or groove extending transverse the direction at which the anchor 124 is oriented that is configured to facilitate embedding of the anchor 124 in the surface of the pallet. The engaging feature 136 may be formed by, for example, punching or stamping an area on one side of the distal portion 132 inwardly with a machine to correspondingly cause the area on the other side to project outwardly as shown on the anchors 124 in FIG. 2. Once the anchors 124 have been advanced and embedded in the surface of the pallet, the projections 136 may interfere and frictionally engage with internal surfaces of pallet (e.g., wood fibers and grains) to inhibit removal of the securing apparatus 100 therefrom.

Figure 3:
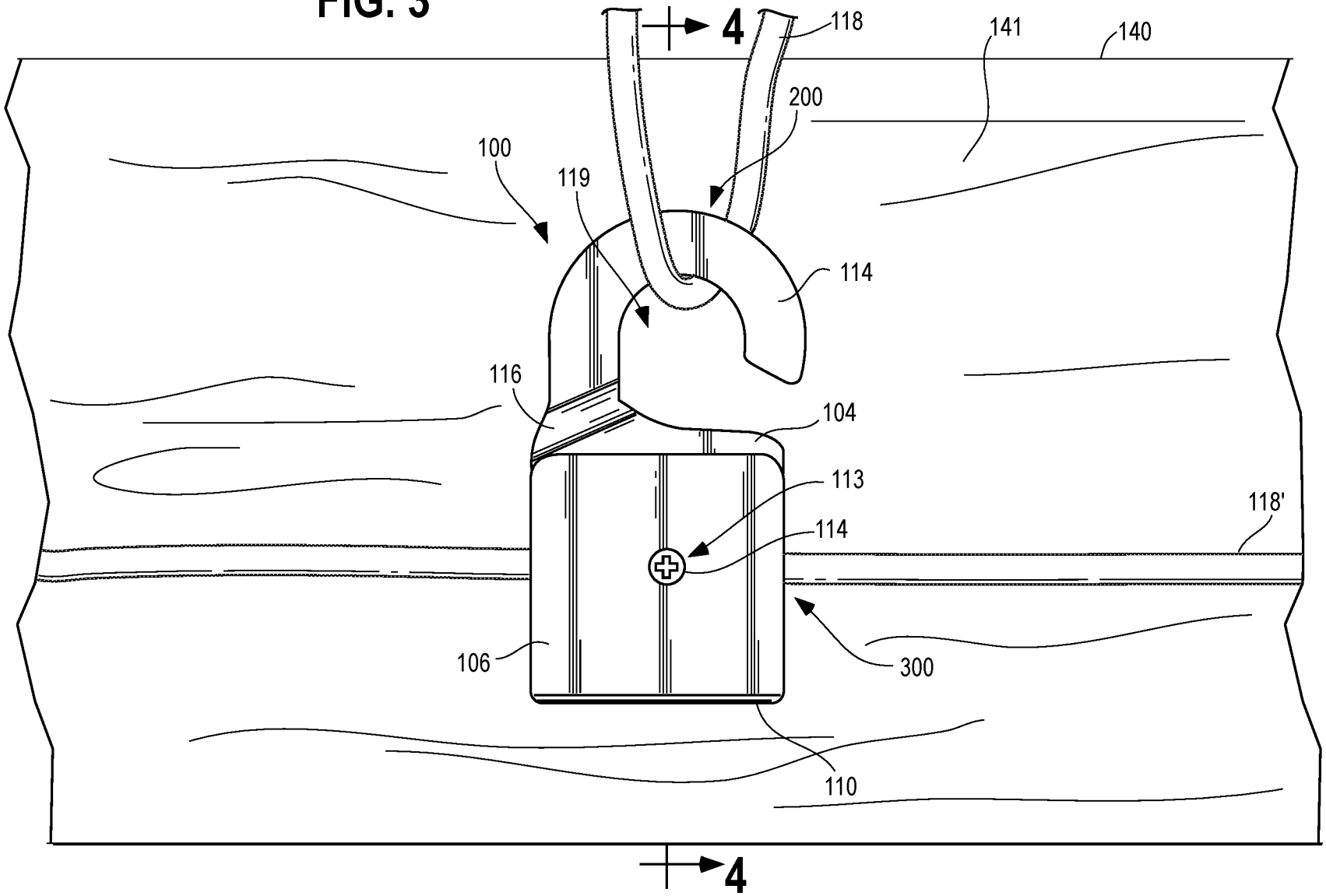
FIG. 3 is a side elevational view showing the securing apparatus of FIG. 1 attached to a pallet using a screw, the securing apparatus having a length of filament looped around the hook and another length of filament positioned in the channel of the main body.
Figure 4:
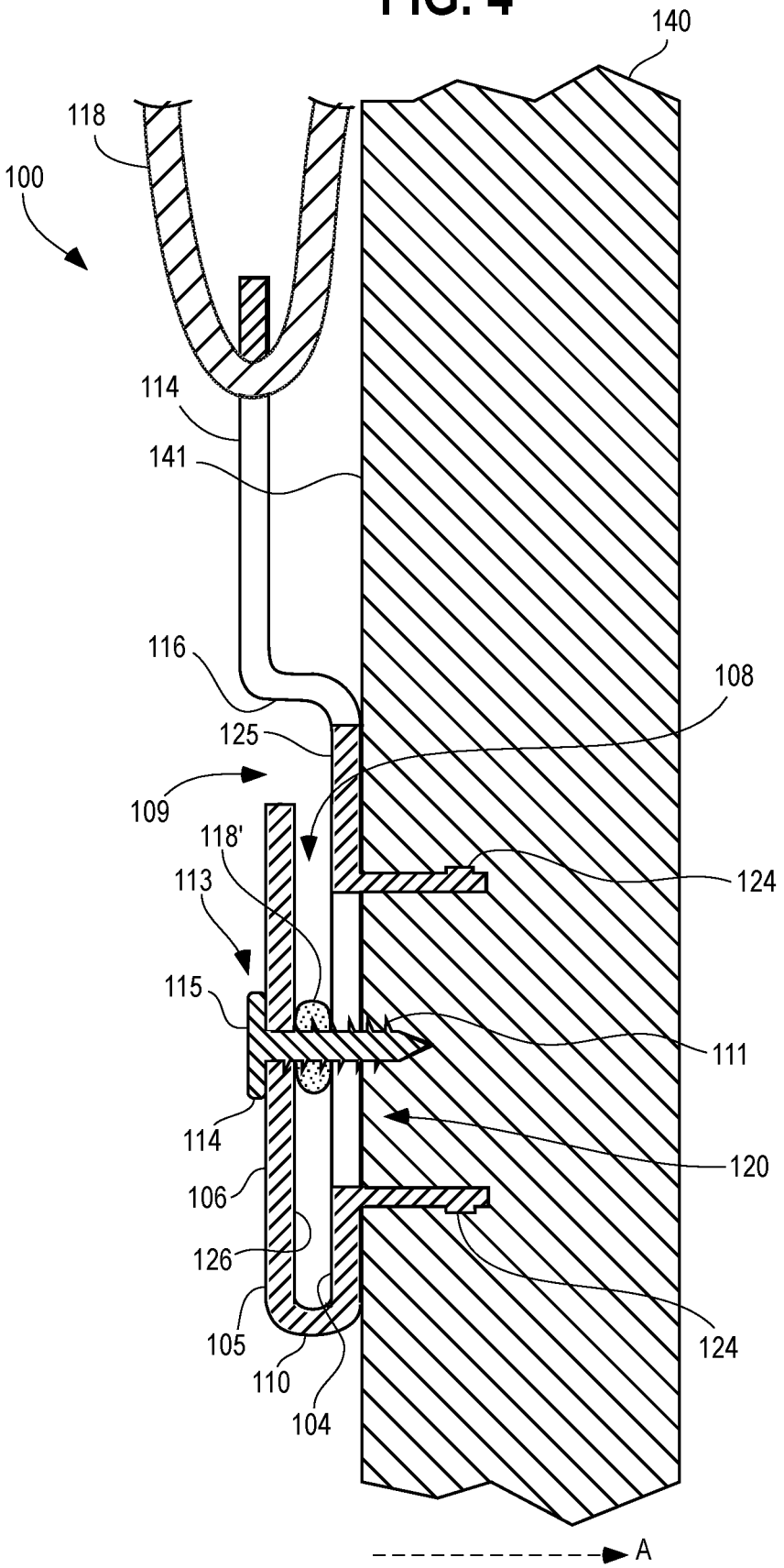
FIG. 4 is a cross-sectional view of the securing apparatus and pallet of FIG. 3 taken across line 4-4.
Figure 12:
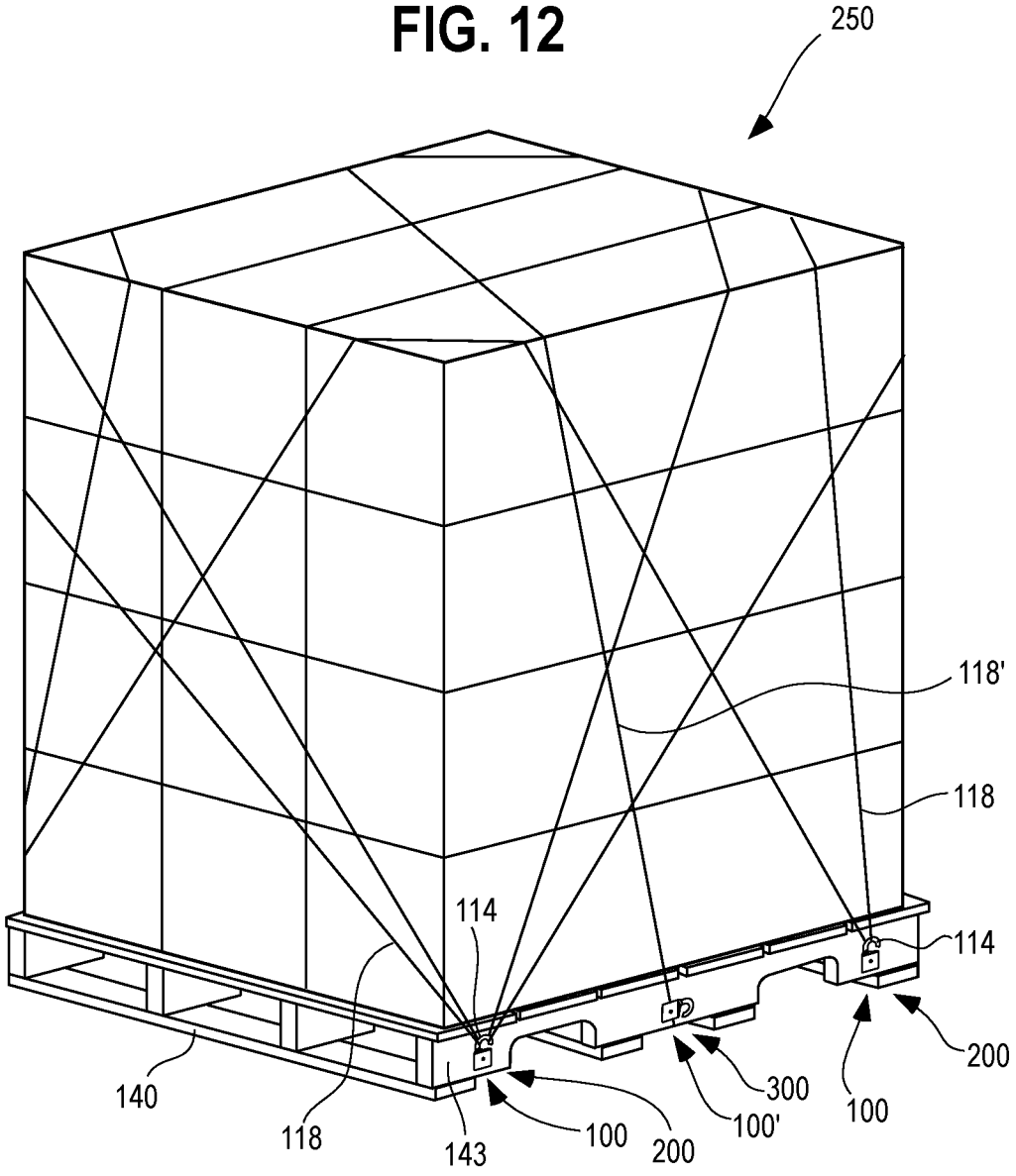
FIG. 12 is a perspective view of a plurality of example securing apparatuses attached to a pallet for securing a plurality of objects to the pallet via filament in different securing configurations.

Referring now to FIGS. 3, 4, and 12, various securing configurations are described with respect to the securing apparatus 100 being removably attached to a pallet 140 having a surface 141. As illustrated, the securing apparatus 100 has been removably attached to the pallet 140 by inserting a fastener 113 such as a screw 114 having shank 111 through the aperture 112 of the second wall portion 106 and advancing the screw 114 into the surface 141 of the pallet 140. In other forms, the fastener 113 may be a nail, pin, spike, or tack. As shown most clearly in FIG. 4, the screw 114 also advances through the opening 120 formed in the first wall portion 104.

In some embodiments, the screw 114 may be configured to facilitate engagement and embedding of the anchors 124 in the pallet 140. In one aspect, the securing apparatus 100 may be positioned proximate the surface 141 of the pallet 140, and as the threads of the shank 111 of the screw 114 engage or "bite" into the surface 141, the head 115 of the screw 114 may abut and contact an outer surface 105 of the second wall portion 106 so as to pull the main body 102 of the securing apparatus 100 closer to the pallet 140 as the screw 114 continues to be advanced in the axial direction A. In turn, this axial movement of the screw 114 correspondingly causes the anchors 124 to dig into and embed themselves in the pallet 140. Alternatively or additionally, a user may embed the anchors 124 manually by, for example, using a hammer to apply force to the main body 102 in the axial direction A and the fastener 113 may be inserted through the aperture 112 and advanced into the pallet 140 thereafter.

In one aspect, the C-shaped hook 114 defines an opening 119 configured to receive a length of filament 118 thereabout such that a loop of the filament 118 may be selectively retained by the hook 114 for securing one or more objects to the pallet 140 in a first securing configuration 200. As described above, the hook 114 is offset from the main body 102 in the axial direction A via the neck portion 116 and is at least partially superior thereto. This offset configuration permits a user to loop a length of the filament 118 around the hook 114 once the securing apparatus 100 is already attached to a pallet 140 (e.g., see FIG. 4 where the first wall portion 104 is closely adjacent to or abutting the pallet 140). In forms where the hook 114 is not offset by the neck portion 116, it may be difficult for the user to loop the length of filament 118 around the hook 114 (e.g., if the hook 114 were laying flush against the surface 141 of the pallet 140). So configured, the offset configuration permits more convenient access to loop filament 118 around the hook 114.

Referring now to FIG. 12, one example of the first securing configuration 200 is described where the securing apparatus 100 may be attached to a base 143 of the pallet 140, and the filament 118 may be looped around the hook 114, wrapped around the objects 250 in a variety of manners, and then attached to another portion of the pallet 140 to secure the objects 250 thereto. As illustrated, a plurality of example securing apparatuses 100 may be used in connection with one another (e.g., on opposite sides of the pallet 140) to secure the filament 118 around the objects 250 on the pallet 140.

Referring back to FIG. 3, another length of filament 118' may additionally or alternatively be positioned in the channel 108 and be used to facilitate securing of one or more objects to the pallet 140 in a second securing configuration 300. The length of filament 118' may be the same filament 118 described with respect to the first securing configuration 200 or may be another separate filament made of the same material as the filament 118. In alternative forms, the filament 118 and filament 118' may be formed of different materials as desired. For example, the filament 118 may be formed of stretch wrap string and the filament 118' may be formed of twine. In some forms, the length of filament 118' may be received via an upper portion 109 of the channel 108 and positioned in the channel 108 such that a portion of the filament 118' is superimposed by the aperture 112 of the second wall portion 106. When the fastener 113 is advanced through the aperture 112 to facilitate attachment of the securing apparatus 100 to the pallet 140, the shank of the fastener 113 may likewise be advanced through the filament 118' positioned in the channel 108 (see FIG. 4) to mechanically engage and inhibit removal of the filament 118'. Once positioned and mechanically secured in the channel 108, the remaining length of the filament 118' may be wrapped around one or more objects secured on the pallet 140.

In addition to the direct mechanical engagement between the fastener 113 and the portion of filament 118 positioned in the channel, the length of filament 118' may also be frictionally engaged by inner surfaces 125, 126 of the first and second wall portions 104, 106 respectively. For example, in some forms, the channel 108 formed between the first and second wall portions 104,106 may be of a lesser width than a width of the filament 118' such that the filament 118' may be compressed and slid into the channel 108 such that the filament 118' abuts and frictionally engages the inner surfaces 125, 126. Additionally or alternatively, the first and second wall portions 104, 106 may be compressed toward one another to frictionally engage the filament 118' in a sandwich-like manner. For example, the filament 118' may be positioned in the channel 108 in the manner described above, and the screw 114 may be advanced through the aperture 112 and into the pallet 140 in the axial direction A. As the head 115 of the screw 114 contacts the outer surface 105 of the second wall portion 106, the head 115 may apply a force to the second wall portion 106 such that the spine portion 110 is slightly deformed, thus reducing the width of the channel 108 and causing the inner surfaces 125, 126 of the first and second wall portions 104, 106 to move closer to one another and sandwich the filament 118' therebetween.

As shown in FIG. 12, and for convenience of discussion, the second securing configuration 300 is illustrated with respect to a securing apparatus 100' that is substantially identical to the example securing apparatus 100. The securing apparatus 100' may be attached to the base 143 of the pallet 140, and the filament 118' may be positioned and mechanically secured in the channel 108 of the securing apparatus 100' as described above. Thereafter, the remaining length of the filament 118' may be wrapped around the objects 250 to facilitate securing the objects 250 to the pallet 140 for transit.

Once the securing apparatuses 100, 100' have been attached to the pallet 140, either one or both of the securing configurations 200, 300 (i.e., using the hook 114 to retain the length of filament 118, or using the channel 108 to retain the length of filament 118') may be used to assist in securing one or more objects to the pallet 140. Although illustrated in FIG. 12 that the securing apparatus 100 is shown using the first securing configuration 200 and the securing apparatus 100' is shown using the second configuration 300, it should be understood that either securing apparatus 100, 100' individually may be configured to use either or both securing configurations at the same time as described. This dual-functionality of the example securing apparatuses described herein provides the user with more options and methods of securing objects to a pallet as desired for specific applications.

Figure 5:
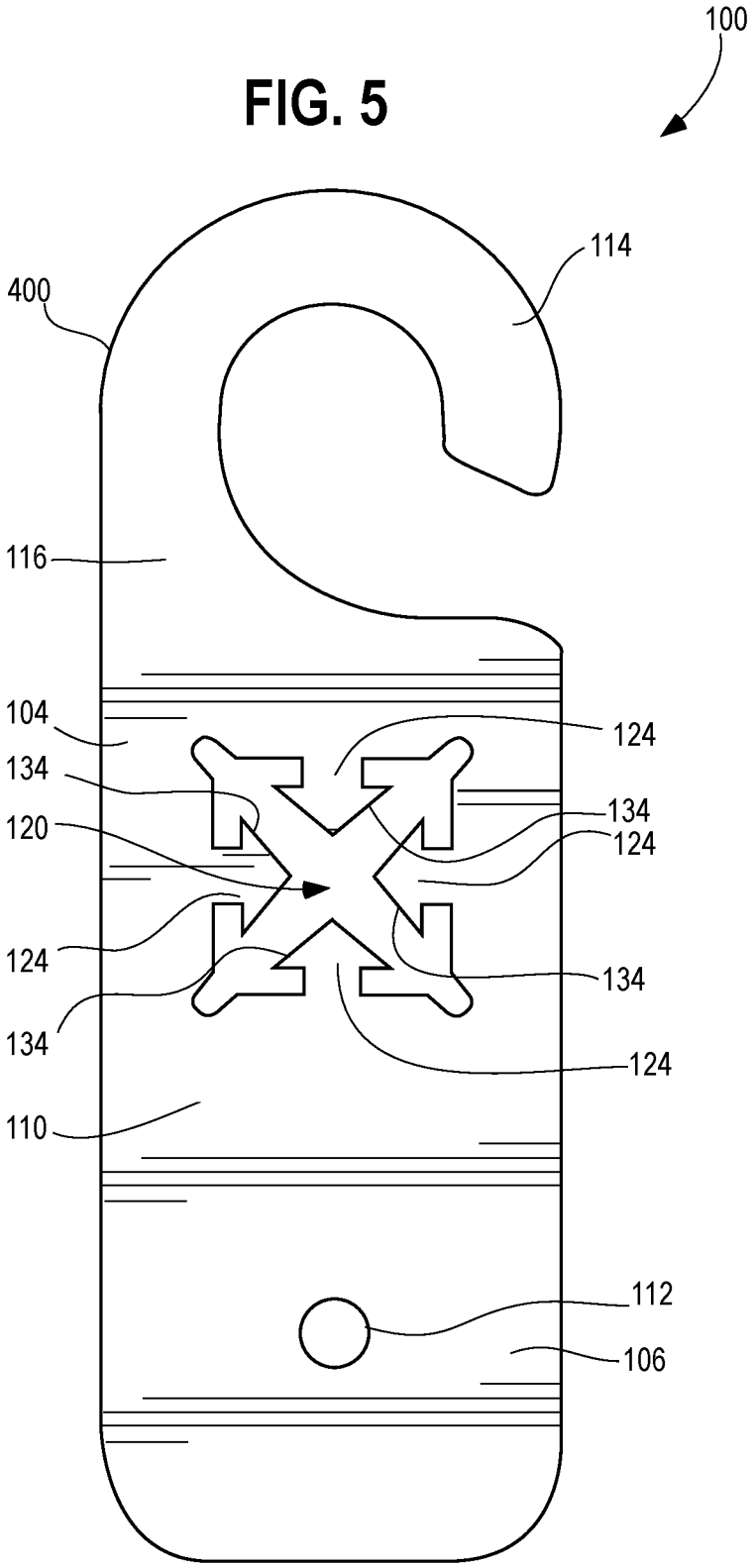
FIG. 5 is a plan view of a blank of material to be used for forming the securing apparatus of FIG. 1.
Figure 6:
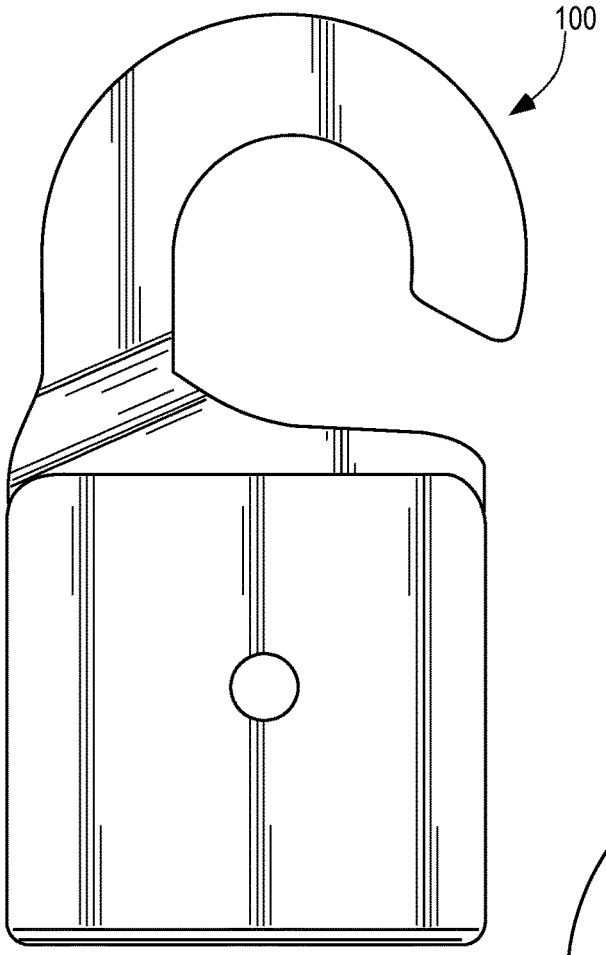
FIG. 6 is a front elevational view of the securing apparatus of FIG. 1.
Figure 7:
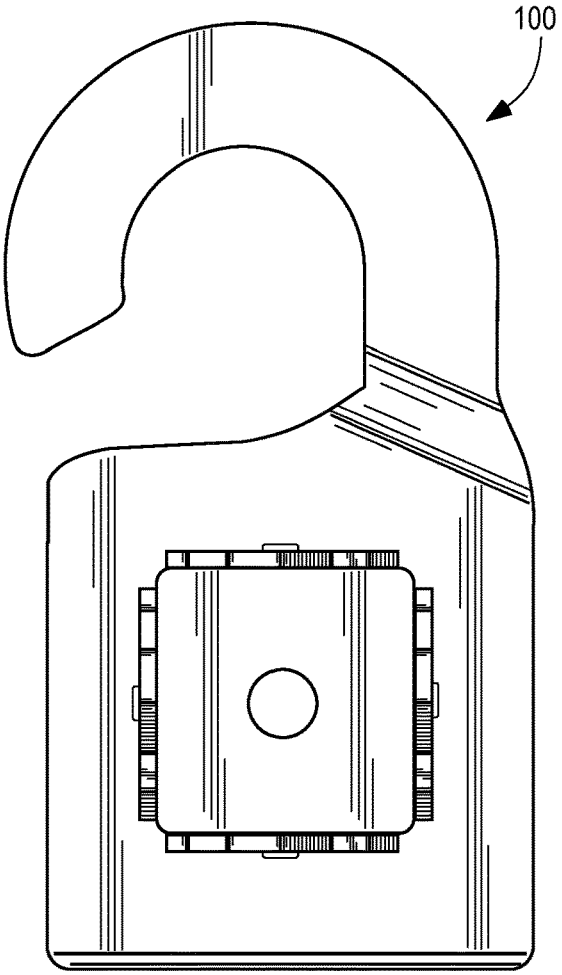
FIG. 7 is a rear elevational view of the securing apparatus of FIG. 1.
Figure 8:
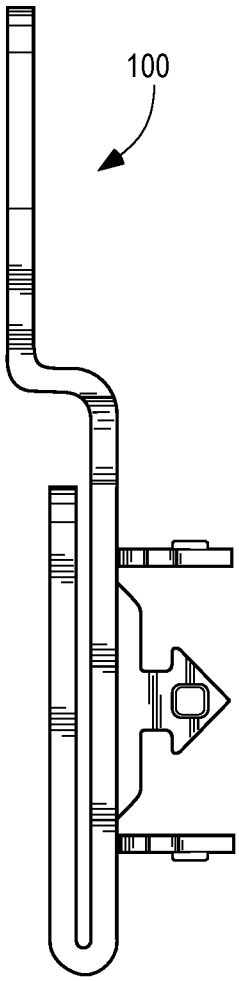
FIG. 8 is a right side elevational view of the securing apparatus of FIG. 1.
Figure 9:
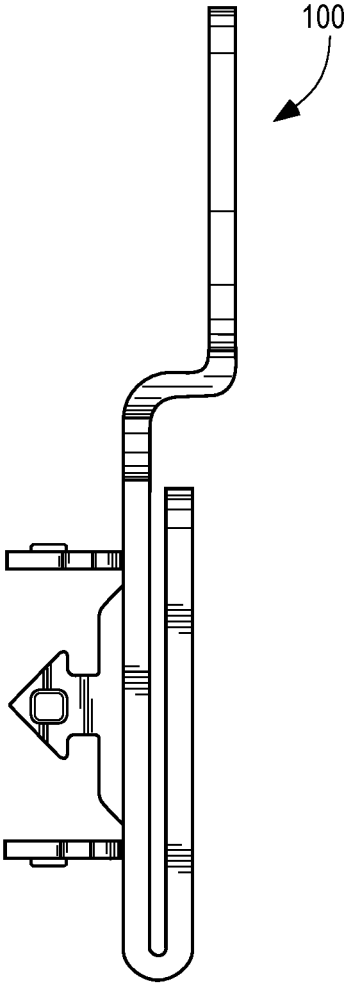
FIG. 9 is a left side elevational view of the securing apparatus of FIG. 1.
Figure 10:
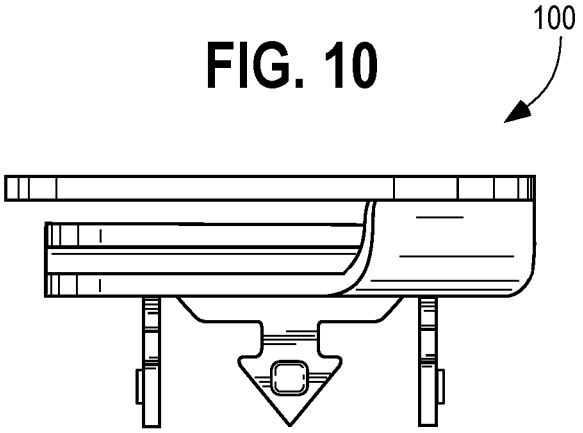
FIG. 10 is a top plan view of the securing apparatus of FIG. 1.
Figure 11:
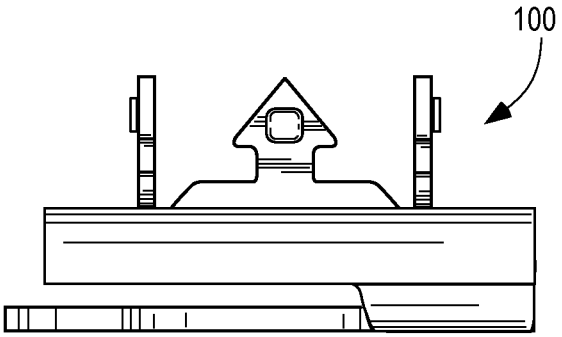
FIG. 11 is a bottom plan view of the securing apparatus of FIG. 1.

Referring now to FIG. 5, by one approach, the securing apparatus 100 may be monolithic and formed of a single blank of material, such as the blank 400 oriented along a first plane. For convenience in description, various portions of the blank 400 are numbered in accordance with the numbering used to describe the already formed securing apparatus 100 shown in FIG. 1, even though various aspects of the securing apparatus 100 may not yet be readily apparent before formed in the manner described hereinafter. As illustrated, the blank 400 may be stamped or cut from a larger piece of material via known means, which can be cost effective for manufacturing purposes. The blank 400 as shown has already been stamped and includes the main body 102 of the securing apparatus 100, the aperture 112, the opening 120 defining the anchors 124, the neck portion 116, and the hook 114. As shown, once the opening 120 has been cut in the blank, the anchors 124 including their distal portions 134 project inwardly into the opening 120 coextensive with the first plane. In order to form the securing apparatus 100 in the manner shown in FIG. 1, the anchors 124 defined by the opening 120 may first be bent outward from the opening 120 (e.g., as shown in FIG. 2) until the anchors 124 are oriented generally transverse to the first plane of the blank 400. Next, the main body 102 may be folded over itself via the spine portion 110 to form the plate-like first wall portion 104 and the plate-like second wall portion 106 such that the channel 108 is formed therebetween. Once the main body 102 has been formed in this manner, the neck portion 116 extending from the first wall portion 104 may be bent at an angle of about thirty degrees to about sixty degrees, or in some instances about ninety degrees, relative to the first plane. The hook 114 attached to the main body 102 via the neck portion 116 may then be bent back towards the first plane until the hook 114 is oriented in a second plane generally parallel the first plane and offset from the main body 102. It should be understood that these example steps for cutting and folding the blank 400 described above may be performed in any order and need not necessarily be performed in the order described.

Referring now to FIGS. 6-11, the example securing apparatus 100 is shown from various additional views to illustrate the components thereof.

While there have been illustrated and described particular embodiments, it will be appreciated that numerous changes and modifications will occur to those skilled in the art, and it is intended for the present disclosure to cover all those changes and modifications which fall within the scope of the appended claims.

What is claimed is:

1. A securing apparatus for securing a load to a pallet, the securing apparatus comprising:

a main body having a first wall portion and a second wall portion spaced from the first wall portion to define a channel therebetween, the first wall portion oriented along a first plane, the main body further including an aperture configured to receive a fastener therethrough for removably attaching the securing apparatus to the pallet;

a hook offset from the main body via a neck portion, the hook oriented along a second plane spaced from the first plane;

at least one anchor extending from the main body in a direction generally transverse the first plane, the anchor configured to be embedded in a portion of the pallet, wherein the first wall portion includes an opening having a periphery, wherein the at least one anchor includes a plurality of anchors, and wherein each of the plurality of anchors extends from the periphery of the opening of the first wall portion.

2. The securing apparatus of claim 1, wherein the first plane is substantially parallel to the second plane.

3. The securing apparatus of claim 1, wherein the first and second wall portions coupled together via a spine portion, the spine portion configured to permit the first and second wall portions to be compressed towards one another.

4. The securing apparatus of claim 1, wherein the main body is formed of a metal material.

5. The securing apparatus of claim 1, wherein the at least one anchor includes an engaging feature configured to facilitate embedding of the at least one anchor in the pallet.

6. The securing apparatus of claim 1, wherein the securing apparatus is monolithic and formed of a single blank of material.

7. A securing apparatus for securing a load to a pallet, the securing apparatus comprising:

a main body having a first wall portion and a second wall portion spaced from the first wall portion to define a channel therebetween, the first wall portion oriented along a first plane, the main body further including an aperture configured to receive a fastener therethrough for removably attaching the securing apparatus to the pallet;

a hook offset from the main body via a neck portion, the hook oriented along a second plane spaced from the first plane;

at least one anchor extending from the main body in a direction generally transverse the first plane, the anchor configured to be embedded in a portion of the pallet, wherein the neck portion extends from the main body at an angle of about 30 degrees to about 60 degrees relative to the first plane.

8. The securing apparatus of claim 7, wherein the neck portion extends from the main body at an angle of about 45 degrees relative to the first plane.

9. The securing apparatus of claim 7, wherein the first plane is substantially parallel to the second plane.

10. The securing apparatus of claim 7, wherein the first and second wall portions coupled together via a spine portion, the spine portion configured to permit the first and second wall portions to be compressed towards one another.

11. The securing apparatus of claim 7, wherein the first wall portion includes an opening having a periphery, wherein the at least one anchor includes a plurality of anchors, and wherein each of the plurality of anchors extends from the periphery of the opening of the first wall portion.

12. The securing apparatus of claim 7, wherein the at least one anchor includes an engaging feature configured to facilitate embedding of the at least one anchor in the pallet.

13. The securing apparatus of claim 7, wherein the at least one anchor includes an arrow-shaped projection.

14. The securing apparatus of claim 13, wherein the first wall portion includes an opening having a periphery, wherein the at least one anchor includes a plurality of anchors, and wherein each of the plurality of anchors extends from the periphery of the opening of the first wall portion.

15. A securing apparatus for securing a load to a pallet, the securing apparatus comprising:

a main body having a first wall portion and a second wall portion spaced from the first wall portion to define a channel therebetween, the first wall portion oriented along a first plane, the main body further including an aperture configured to receive a fastener therethrough for removably attaching the securing apparatus to the pallet;

a hook offset from the main body via a neck portion, the hook oriented along a second plane spaced from the first plane;

at least one anchor extending from the main body in a direction generally transverse the first plane, the anchor configured to be embedded in a portion of the pallet, wherein the at least one anchor includes an arrow-shaped projection.

16. The securing apparatus of claim 15, wherein the first plane is substantially parallel to the second plane.

17. The securing apparatus of claim 15, wherein the first and second wall portions coupled together via a spine portion, the spine portion configured to permit the first and second wall portions to be compressed towards one another.

18. The securing apparatus of claim 15, wherein the first wall portion includes an opening having a periphery, wherein the at least one anchor includes a plurality of anchors, and wherein each of the plurality of anchors extends from the periphery of the opening of the first wall portion.

19. The securing apparatus of claim 15, wherein the at least one anchor includes an engaging feature configured to facilitate embedding of the at least one anchor in the pallet.

20. A kit for securing a load to a pallet, the kit comprising:

a securing apparatus comprising:

a main body having a first wall portion and a second wall portion spaced from the first wall portion to define a channel therebetween, the first wall portion oriented along a first plane, the main body further including an aperture configured to receive a fastener therethrough for removably attaching the securing apparatus to the pallet;

a hook offset from the main body via a neck portion, the hook oriented along a second plane spaced from the first plane; and at least one anchor extending from the main body in a direction generally transverse the first plane, the anchor configured to be embedded in a portion of the pallet; and a fastener configured to be received in the aperture of the main body for removably coupling the securing apparatus to the pallet.

21. The kit of claim 20, wherein the neck portion extends from the main body at an angle of about 30 degrees to about 60 degrees relative to the first plane.

22. The kit of claim 20, wherein the first wall portion includes an opening having a periphery, wherein the at least one anchor includes a plurality of anchors, and wherein each of the plurality of anchors extends from the periphery of the opening of the first wall portion.

23. The kit of claim 20, wherein the at least one anchor includes an arrow-shaped projection.

24. A method of securing a load to a pallet using a securing apparatus, the method comprising:

receiving a fastener through an aperture of a main body for removably coupling the securing apparatus to the pallet, the securing apparatus comprising:

the main body having a first wall portion and a second wall portion spaced from the first wall portion to define a channel therebetween, the first wall portion oriented along a first plane, the main body further including the aperture configured to receive the fastener therethrough for removably attaching the securing apparatus to the pallet;

a hook offset from the main body via a neck portion, the hook oriented along a second plane spaced from the first plane;

at least one anchor extending from the main body in a direction generally transverse the first plane, the anchor configured to be embedded in a portion of the pallet;

engaging the at least one anchor in the pallet; and receiving a length of filament around the hook to facilitate securing a load to the pallet in a first securing configuration.

25. The method of claim 24, further comprising receiving another length of filament in the channel between the first and second wall portions; and frictionally engaging the other length of filament with the first and second wall portions in a second securing configuration.

26. The method of claim 25, further comprising engaging the other length of filament in the channel with the fastener to inhibit removal of the length of filament from the channel.

* * * * *